US010714856B2

(12) United States Patent
Huang

(10) Patent No.: US 10,714,856 B2
(45) Date of Patent: Jul. 14, 2020

(54) ELECTRICAL CONNECTOR AND ELECTRICAL CONNECTOR ASSEMBLY THEREOF

(71) Applicant: LOTES CO., LTD, Keelung (TW)

(72) Inventor: Chang Wei Huang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/522,009

(22) Filed: Jul. 25, 2019

(65) Prior Publication Data

US 2020/0076108 A1 Mar. 5, 2020

(30) Foreign Application Priority Data

Aug. 31, 2018 (CN) ..... 2018 1 1011126

(51) Int. Cl.

| | |
|---|---|
| ***H01R 13/193*** | (2006.01) |
| ***H01R 13/11*** | (2006.01) |
| ***H01R 13/04*** | (2006.01) |
| ***H01R 12/58*** | (2011.01) |
| ***H01R 12/71*** | (2011.01) |
| ***H01R 13/40*** | (2006.01) |

(Continued)

(52) U.S. Cl.

CPC ..... *H01R 13/193* (2013.01); *H01R 4/02* (2013.01); *H01R 12/58* (2013.01); *H01R 12/716* (2013.01); *H01R 12/87* (2013.01); *H01R 13/04* (2013.01); *H01R 13/11* (2013.01); *H01R 13/40* (2013.01)

(58) Field of Classification Search

CPC .. H01R 23/725; H01R 23/02; H01R 23/7068; H01R 13/193; H01R 13/11; H01R 13/04; H01R 13/40; H01R 12/58; H01R 12/716; H01R 12/87; H01R 4/02

USPC ..... 439/924.1, 682–691

See application file for complete search history.

(56) References Cited

U.S. PATENT DOCUMENTS 4,084,875 A * 4/1978 Yamamoto ..... H01R 13/629 439/274

4,934,967 A 6/1990 Marks et al.

(Continued)

FOREIGN PATENT DOCUMENTS

CN 2351885 Y 12/1999

CN 2351886 Y 12/1999

(Continued)

*Primary Examiner* — Gary F Paumen

(74) *Attorney, Agent, or Firm* — Locke Lord LLP; Tim Tingkang Xia, Esq.

(57) ABSTRACT

An electrical connector is used for a plug having multiple pins to downward insert therein. The electrical connector includes a body provided with multiple accommodating holes running through an upper surface and a lower surface of the body; and multiple terminals correspondingly accommodated in the accommodating holes. Upper ends of the terminals are located at a same height, and lower ends of the terminals are located at a same height. Each terminal has two contact arms opposite and close to each other. The terminals include a first terminal and a second terminal. The two contact arms of the first terminal and the two contact arms of the second terminal are located at different heights and correspondingly used for the pins to insert downward therein successively. Thus, signal interference between the terminals can be reduced, and a maximum insertion force of the plug inserted into the electrical connector is reduced.

20 Claims, 12 Drawing Sheets

(51) Int. Cl.
*H01R 4/02* (2006.01)
*H01R 12/87* (2011.01)

(56) References Cited

U.S. PATENT DOCUMENTS 5,295,856 A * 3/1994 Endo ..... H01R 13/6215 439/364
5,586,915 A * 12/1996 Baker ..... H01R 12/82 439/733.1
5,591,035 A * 1/1997 Burkholder ..... H01R 12/724 439/79
5,662,483 A * 9/1997 Park ..... H01R 13/6485 439/101
6,916,188 B2 * 7/2005 Lang ..... H01R 13/514 439/101
7,789,714 B2 * 9/2010 Liu ..... H01R 12/716 439/682
8,152,558 B2 * 4/2012 Broeksteeg ..... B60R 11/0241 439/378

FOREIGN PATENT DOCUMENTS

CN 201364993 Y 12/2009
CN 202855978 U 4/2013
CN 203103564 U 7/2013
CN 204538360 U 8/2015

* cited by examiner

A-A

ELECTRICAL CONNECTOR AND ELECTRICAL CONNECTOR ASSEMBLY THEREOF

CROSS-REFERENCE TO RELATED PATENT APPLICATION

This non-provisional application claims priority to and the benefit of, pursuant to 35 U.S.C. § 119(a), patent application Serial No. CN201811011126.3 filed in China on Aug. 31, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and an electrical connector assembly thereof, and particularly to an electrical connector with low insertion force and an electrical connector assembly thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing socket connector is used for a plug connector having a plurality of plug terminals to insert therein. The socket connector includes an insulating body and a plurality of socket terminals fixed in the insulating body. Each socket terminal has a pair of clamping arms. The clamping arms of all the socket terminals are located at a same height, and all the plug terminals are located at a same height. Therefore, at the start of insertion of the plug terminals and the socket terminals, all the plug terminals need to overcome a maximum insertion force between the plug terminals and the socket terminals. Hence, during insertion, the plug terminals can only be inserted into the socket terminals by applying a large force. In this case, the socket terminals may be easily damaged due to an excessive insertion force, thereby shortening service life of the receptacle connector, and causing the insertion of the plug connector and the socket connector not to be facilitated.

Therefore, a heretofore unaddressed need to design a new electrical connector exists in the art to address the aforementioned deficiencies and inadequacies.

SUMMARY

The present invention is directed to provide an electrical connector capable of effectively reducing a maximum insertion force of a plug inserted into the electrical connector, and ensuring stable transmission of a high-speed signal, and an electrical connector assembly thereof.

In order to achieve the foregoing objective, the present invention adopts the following technical solutions:

An electrical connector is configured for a plug having a plurality of pins to downward insert therein. The electrical connector includes: a body, provided with a plurality of accommodating holes running through an upper surface and a lower surface of the body; and a plurality of terminals, correspondingly accommodated in the accommodating holes, wherein upper ends of the terminals are located at a same height, lower ends of the terminals are located at a same height, each of the terminals has two contact arms opposite and close to each other, the terminals include a first terminal and a second terminal, and the two contact arms of the first terminal and the two contact arms of the second terminal are located at different heights and correspondingly configured for the pins to insert downward therein successively.

In certain embodiments, upper ends of the two contact arms of the first terminal and upper ends of the two contact arms of the second terminal are located at a same height, and lower ends of the two contact arms of the first terminal and lower ends of the two contact arms of the second terminal are located at different heights.

In certain embodiments, structures of the first terminal and the second terminal other than the two contact arms are all identical.

In certain embodiments, each of the terminals comprises a base, two first extending portions and two second extending portions respectively bending and extending from two opposite sides of the base, and two connecting portions respectively connecting the two first extending portions to the two second extending portions, the two contact arms are formed by respectively extending from the two first extending portions toward the two second extending portions, and extending lengths of the two contact arms of the first terminal and extending lengths of the two contact arms of the second terminal are different.

In certain embodiments, the first extending portions are located above the second extending portions, and in a vertical direction, a width of each of the first extending portions is greater than a width of each of the second extending portions.

In certain embodiments, a gap between the two second extending portions is gradually decreased along a direction toward the two first extending portions.

In certain embodiments, the two connecting portions abut each other.

In certain embodiments, each of the terminals further comprises two positioning portions bending and extending from the two opposite sides of the base, and two clamping portions bending and extending from the two opposite sides of the base, the two second extending portions are located between the two first extending portions and the two positioning portions, the two positioning portions are configured to position the terminal on the body, and the two clamping portions are located below the two positioning portions and configured to clamp a solder.

In certain embodiments, a gap between the two connecting portions is smaller than a gap between the two positioning portions.

In certain embodiments, the two first extending portions, the two second extending portions and the two positioning portions are all hollow cylindrical shaped, an aperture of each of the two first extending portions is equal to an aperture of each of the two second extending portions, and an aperture of each of the two positioning portions is greater than the aperture of each of the two second extending portions.

In certain embodiments, the two first extending portions, the two second extending portions, the two positioning portions and the two clamping portions all bend and extend respectively from a left side and a right side of the base toward a front side of the base.

In certain embodiments, a width of each of the positioning portions is gradually increased in an extending direction thereof, and the positioning portions outward abut a corresponding one of the accommodating holes so as to position the terminal in a horizontal direction.

In certain embodiments, when the pins are downwards inserted into a final position thereof, a lower end of each of the pins is located above a corresponding one of the positioning portions.

In certain embodiments, a groove is formed between two adjacent ones of the accommodating holes to communicate the two adjacent ones of the accommodating holes with each other, the groove is downward concavely provided on an upper surface of the body, each of the terminals is protrudingly provided with two position limiting portions opposite to each other, the two position limiting portions are located above the two contact arms, two adjacent position limiting portions of two adjacent terminals of the terminals are accommodated in a same groove, and a bottom surface of the groove is located below the position limiting portions to limit the terminals from moving downward.

In certain embodiments, each of the terminals has two through holes opposite to each other, the position limiting portions are formed by extending downward and outward from upper ends of the through holes correspondingly, and intervals exist between each of the position limiting portions and two opposite side edges of a corresponding one of the through holes.

In certain embodiments, each of the terminals has a notch formed by being downward concavely provided on an upper end of the terminal, and intervals exist between the notch and the through holes.

To achieve the foregoing objectives, the electrical connector assembly according to the present invention adopts the following technical solution:

An electrical connector assembly includes: a plug, including a base seat and a plurality of pins fixed to the base seat; and an electrical connector, mated with the plug. The electrical connector includes: a body, provided with a plurality of accommodating holes penetrating vertically; and a plurality of terminals, correspondingly accommodated in the accommodating holes, wherein upper ends of the terminals are located at a same height, lower ends of the terminals are located at a same height, each of the terminals has two contact arms opposite and close to each other, the terminals include a first terminal and a second terminal, and the two contact arms of the first terminal and the two contact arms of the second terminal are located at different heights and correspondingly configured for the pins to insert downward therein successively.

In certain embodiments, each of the pins has a head portion, an insertion portion and a middle portion connecting the head portion to the insertion portion, a diameter of the head portion, a diameter of the insertion portion and a diameter of the middle portion are different, the insertion portion extends downward to pass beyond a bottom surface of the base seat and is downward inserted and in contact with the two contact arms, and the middle portion and the base seat are in stationary fit.

In certain embodiments, the diameter of the head portion is greater than the diameter of the middle portion, and the diameter of the middle portion is greater than the diameter of the insertion portion.

In certain embodiments, the pins are correspondingly riveted and fixed to the based seat downward from top thereof, and upper ends of the pins are located at a same height and are flush with a top surface of the base seat.

Compared with the related art, the electrical connector and the electrical connector assembly thereof according to certain embodiments of the present invention have the following beneficial effects:

The upper ends of the terminals are located at the same height, and the lower ends of the terminals are located at the same height. When the electrical connector is inserted with the plug, signal interference between the terminals can be reduced, ensuring that transmission of a high-speed signal can be stably conducted between the electrical connector and the plug. Meanwhile, the two contact arms of the first terminal and the two contact arms of the second terminal are located at different heights and correspondingly configured for the pins to insert downward therein successively, reducing the maximum insertion force of the plug inserted into the electrical connector, and prolonging service life of the electrical connector assembly.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
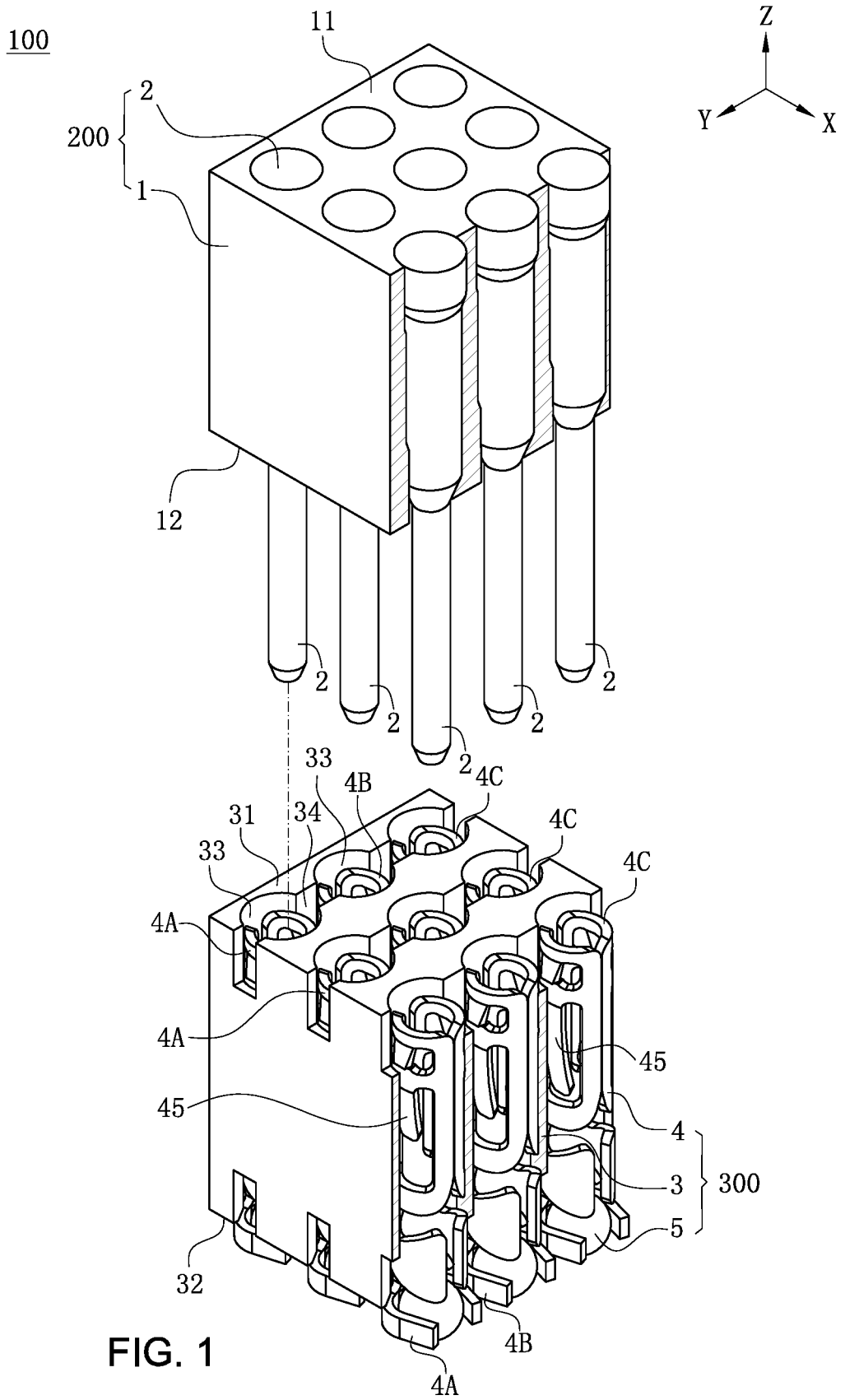
FIG. 1 is a perspective view of an electrical connector and a plug according to one embodiment of the present invention before insertion.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector and an electrical connector assembly.

Referring to FIG. 1, a front-rear direction X as well as a left-right direction Y and a vertical direction Z that are perpendicular to the front-rear direction X are defined for an electrical connector assembly 100 according to one embodiment of the present invention.

Figure 7:
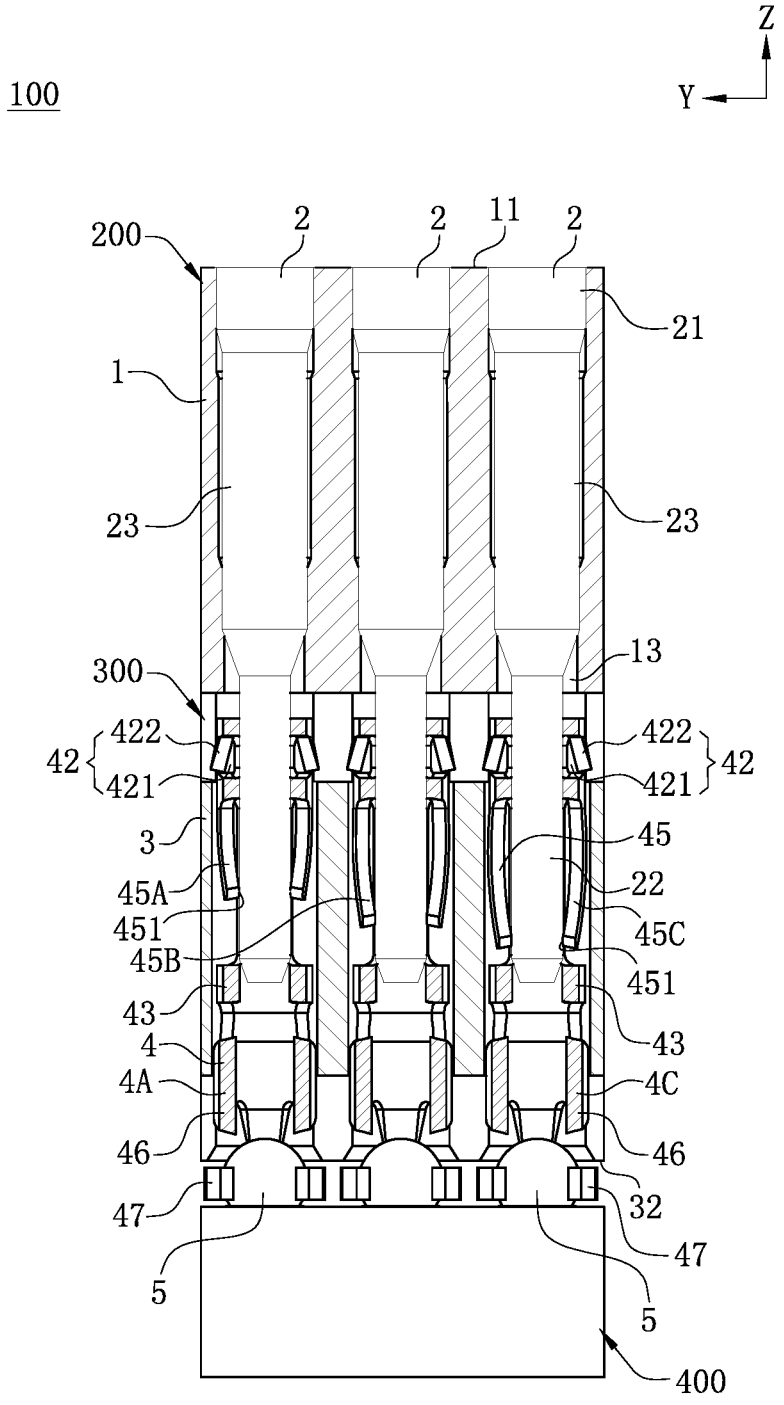
FIG. 7 is a schematic view of an electrical connector and a plug in FIG. 6 after insertion.

Referring to FIG. 1 and FIG. 7, the electrical connector assembly 100 according to one embodiment of the present invention includes a plug 200, an electrical connector 300 mated with the plug 200, and a circuit board 400 soldered below the electrical connector 300.

Figure 2:
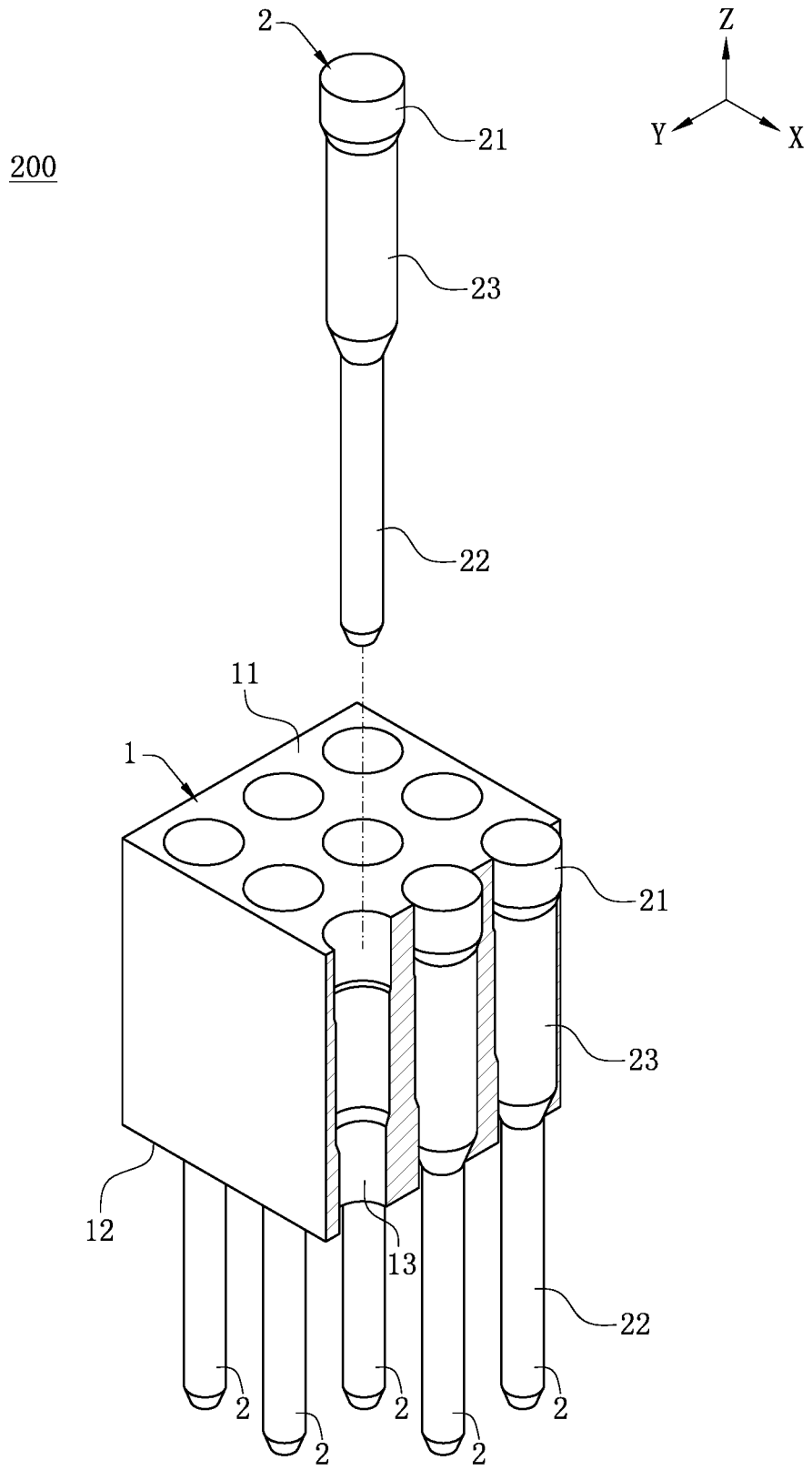
FIG. 2 is a perspective view of the plug in FIG. 1.

Referring to FIG. 2, the plug 200 includes a base seat 1 and a plurality of pins 2 fixed to the base seat 1.

Figure 5:
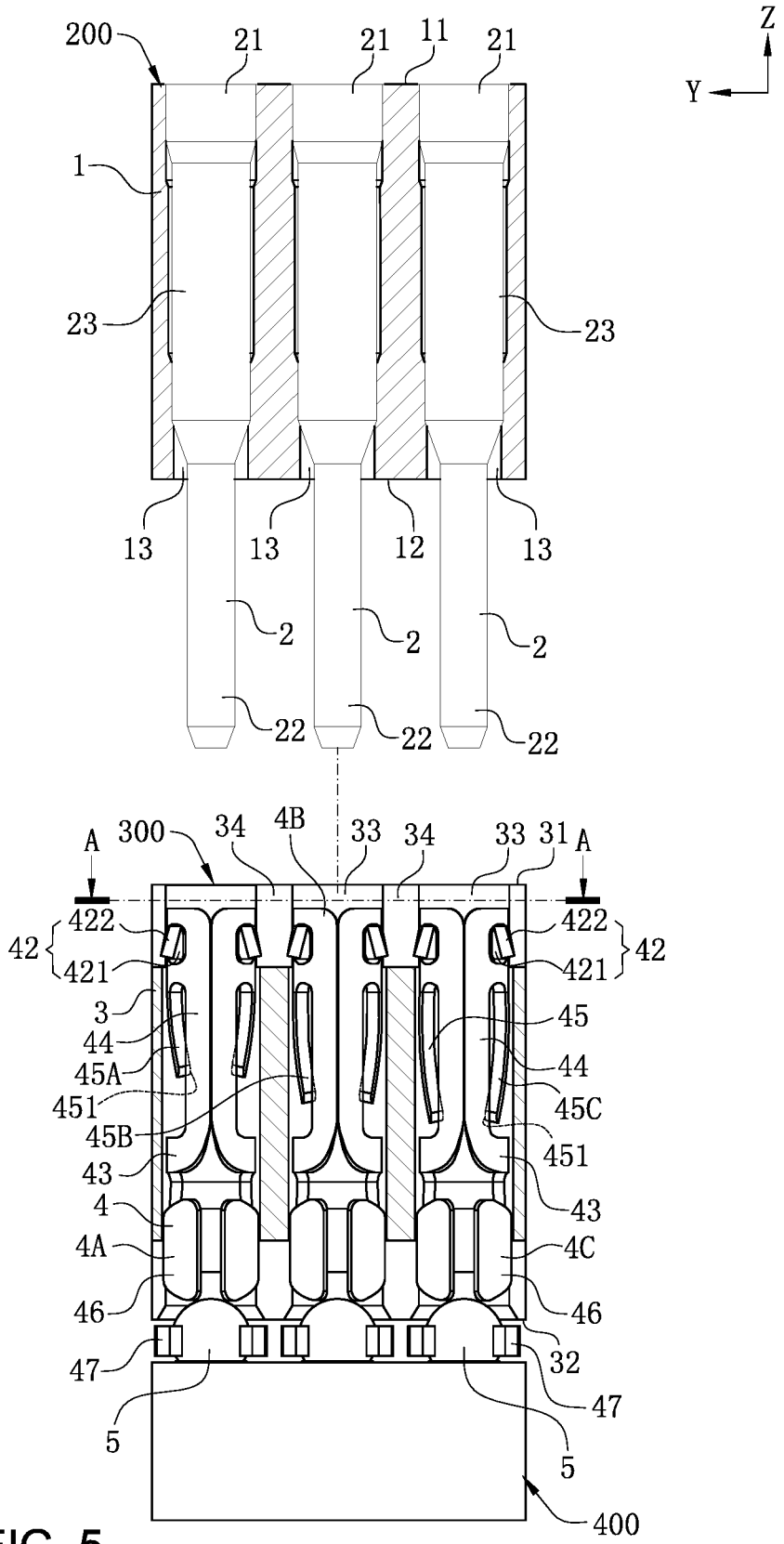
FIG. 5 is a front view of the electrical connector and the plug in FIG. 1 before insertion.

Referring to FIG. 2 and FIG. 5, the base seat 1 is made of an insulating material. The base seat 1 has a top surface 11 and a bottom surface 12 opposite to each other, and a plurality of fixing grooves 13 running through the top surface 11 and the bottom surface 12 vertically. In each fixing groove 13, there is a step surface facing the top surface 11.

Referring to FIG. 2 and FIG. 5, the pins 2 are made of metal and are cylindrical shaped. The pins 2 are correspondingly riveted and fixed in the fixing grooves 13 downward from top thereof, which enhances a fixing effect of the pins 2 in the base seat 1. The pins 2 are arranged in a plurality of rows and a plurality of columns, and the pins 2 are located at a same height. That is, upper ends of the pins 2 are flush with one another, and lower ends of the pins 2 are flush with one another.

Referring to FIG. 2 and FIG. 5, each pin 2 has a head portion 21, an insertion portion 22 and a middle portion 23 connecting the head portion 21 to the insertion portion 22. The insertion portion 22 extends downward to pass beyond the bottom surface 12. The middle portion 23 is fixed to the fixing groove 13 in an interference fit, and a diameter of the middle portion 23 is greater than a diameter of the insertion portion 22, which ensures that there is a sufficient contact area between the middle portion 23 and the fixing groove 13. A diameter of the head portion 21 is greater than the diameter of the middle portion 23, which enhances the strength of the head portion 21, such that the pins 2 are correspondingly riveted and fixed to the plurality of fixing grooves 13 conveniently downward from top thereof, and the head portion 21 downward abuts the step surface in the fixing groove 13, thereby avoiding the pin 2 from being detached downward away from the base seat 1 when the plug 200 is pulled upward out of the electrical connector 300. An upper end of the head portion 21 is flush with the top surface 11, which avoids an upper end of the pin 1 from being exposed above the top surface 11 and being consequently damaged.

Figure 3:
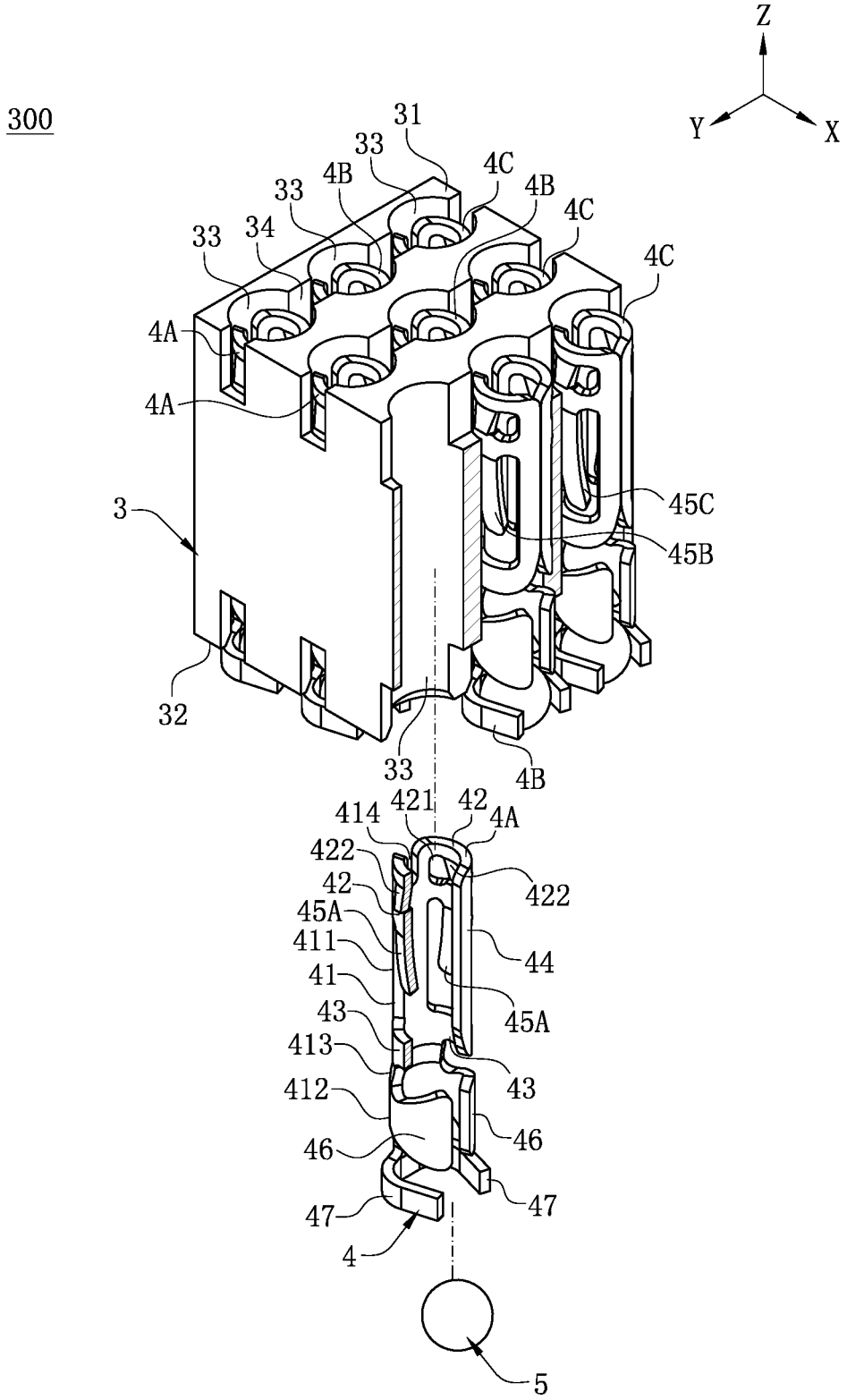
FIG. 3 is a perspective view of the electrical connector in FIG. 1.

Referring to FIG. 3, the electrical connector 300 includes a body 3, a plurality of terminals 4 accommodated in the body 3, and a plurality of solders 5.

Figure 8:
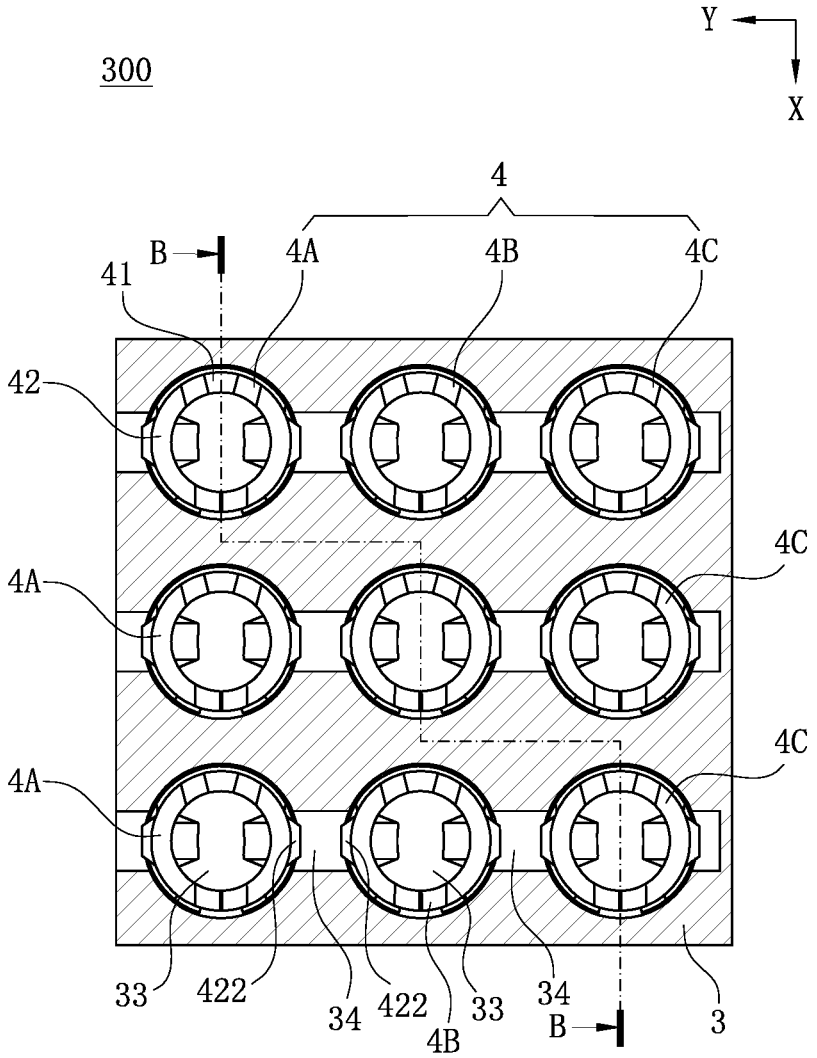
FIG. 8 is a sectional view of an electrical connector in FIG. 5 in an A-A direction.

Referring to FIG. 3, FIG. 5 and FIG. 8, the body 3 is made of an insulating material. The body 3 has an upper surface 31 and a lower surface 32 opposite to each other, and a plurality of accommodating holes 33 running through the upper surface 31 and the lower surface 32 vertically. The accommodating holes 33 are cylindrical shaped with an equal aperture. A groove 34 is formed between two adjacent accommodating holes 33 of the body 3 to communicate the two adjacent accommodating holes 33 with each other. The groove 34 is downward concavely provided on the upper surface 31, and does not run downward through the lower surface 32.

Figure 4:
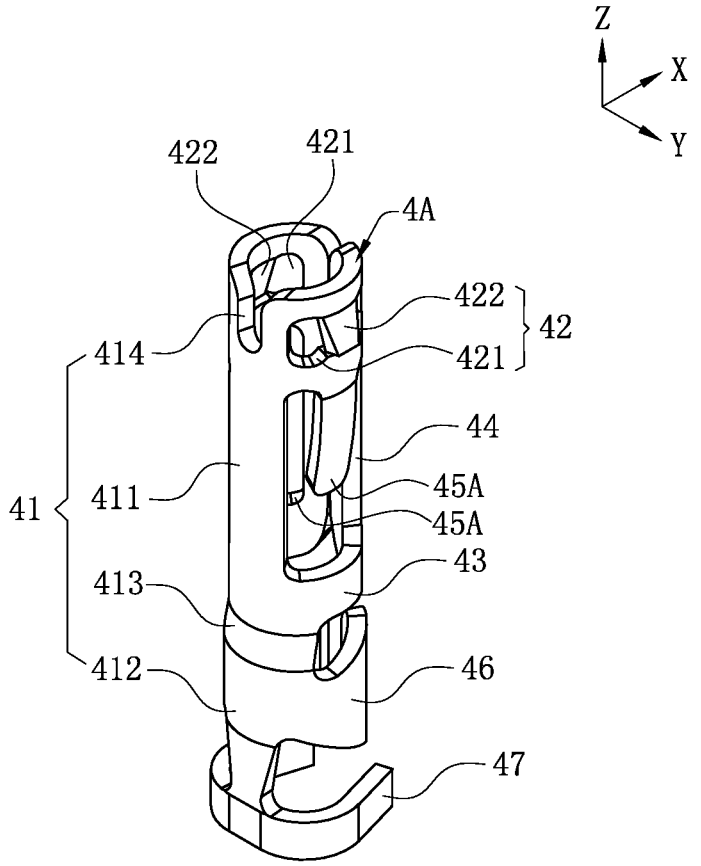
FIG. 4 is a perspective view of a terminal in FIG. 3 viewing from another angle.

Referring to FIG. 3, FIG. 4 and FIG. 5, the terminals 4 are made of metal and is upward assembled in the accommodating holes 33 correspondingly. The terminals 4 are arranged in a plurality of rows and a plurality of columns. Upper ends of the terminals 4 are located at a same height, and lower ends of the terminals 4 are located at a same height. Each terminal 4 includes a base 41, two first extending portions 42, two second extending portions 43, two connecting portions 44, two contact arms 45, two positioning portions 46 and two clamping portions 47. The terminals 4 include a plurality of first terminals 4A, a plurality of second terminals 4B and a plurality of third terminals 4C. Structures of the first terminals 4A, the second terminals 4B and the third terminals 4C are different. Each of the first terminals 4A, the second terminals 4B and the third terminals 4C have one row. In other embodiments, the first terminals 4A, the second terminals 4B and the third terminals 4C each may have a plurality of rows and are alternately distributed.

Referring to FIG. 3 and FIG. 4, the base 41 includes a first portion 411, a second portion 412 and a third portion 413 connecting the first portion 411 to the second portion 412. The first portion 411 is located above the third portion 413, and an upper end of the first portion 411 is downward concavely provided with a notch 414.

Figure 9:
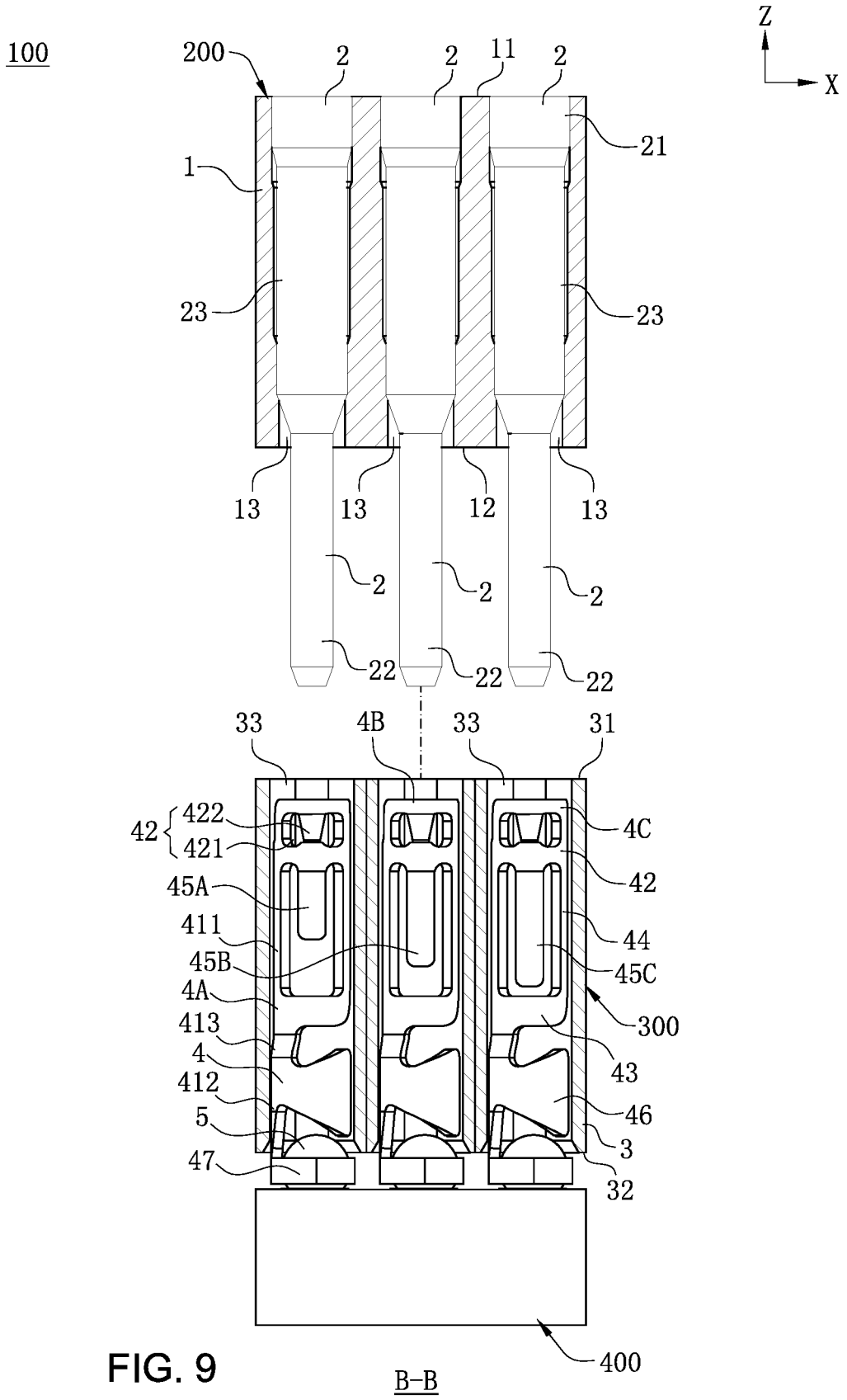
FIG. 9 is a sectional view of an electrical connector and a plug in FIG. 8 in a B-B direction before insertion.

Referring to FIG. 9, the first portion 411 and the second portion 412 are formed by extending in a vertical direction, and the third portion 413 is formed by obliquely extending from the first portion 411 toward the second portion 412.

Referring to FIG. 3, FIG. 5 and FIG. 8, the two first extending portions 42 bend and extend forward from left and right sides of an upper end of the first portion 411, and the two first extending portions 42 are hollow cylindrical shaped. Each first extending portion 42 has a through hole 421 and a position limiting portion 422 extending downward and outward from an upper end of the through hole 421. An interval exists between the through hole 421 and the notch 414. The position limiting portion 422 and two opposite side edges of the through hole 421 are provided separately in the front-rear direction X. A width of the position limiting portion 422 is gradually decreased in an extending direction thereof, so as to increase the elasticity of the position limiting portion 422. Two adjacent position limiting portions 422 of two adjacent terminals 4 are accommodated in the same groove 34, and a bottom surface of the groove 34 is located below the position limiting portions 422 to limit the terminals 4 from moving downward.

Referring to FIG. 3, FIG. 5 and FIG. 8, the two second extending portions 43 bend and extend forward from left and right sides of a lower end of the first portion 411. The two second extending portions 43 are hollow cylindrical shaped, and an aperture of each of the two second extending portions 43 is equal to an aperture of each of the two first extending portions 42. In the vertical direction Z, a width of each second extending portion 43 is smaller than a width of each first extending portion 42. Front ends of the two second extending portions 43 are arc shaped, and a gap between the front ends of the two second extending portions 43 is gradually decreased along a direction toward the two first extending portions 42.

Figure 11:
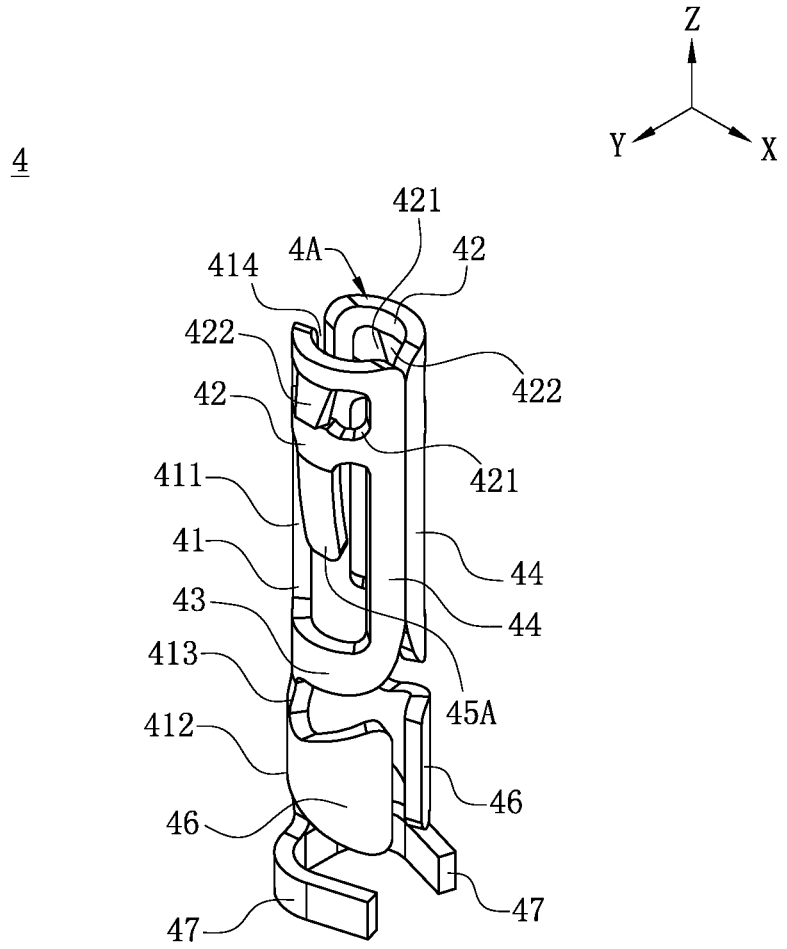
FIG. 11 is a perspective view of a terminal according to another embodiment of the present invention.
Figure 12:
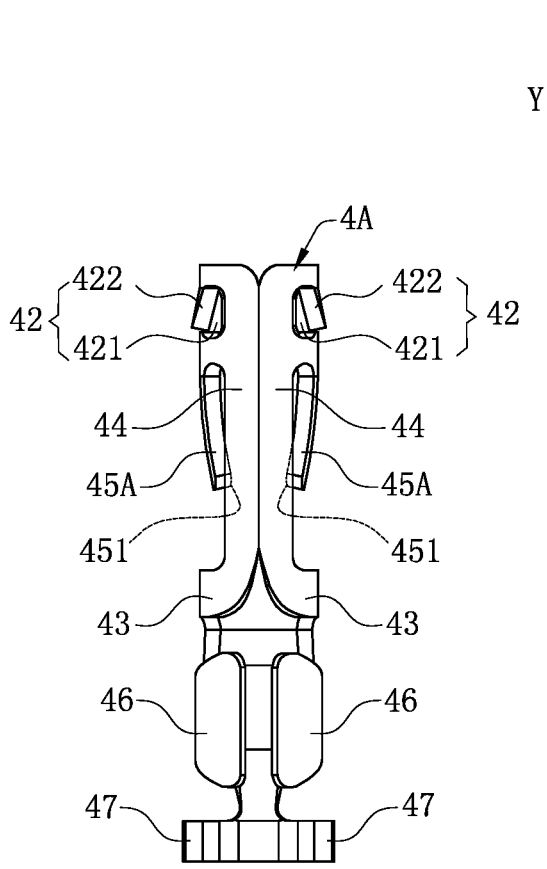
FIG. 12 is a front view of a terminal in FIG. 11.

Referring to FIG. 3, FIG. 5 and FIG. 8, the two connecting portions 44 are respectively connected to lower sides of the front ends of the two first extending portions 42 and upper sides of front ends of the two second extending portions 43, and there is a gap between front ends of the two connecting portions 44. As shown in FIG. 11 and FIG. 12, in another embodiment, the front ends of the two connecting portions 44 abut each other, thereby allowing the two connecting portions 44 to be electrically conductive to each other, and further improving signal transmission capacity between the pins 2 and the terminals 4.

Referring to FIG. 3, FIG. 5 and FIG. 8, the two contact arms 45 extend downward toward the second extending portion 43 and get close to each other from lower ends of the two first extending portions 42. The two contact arms 45 are located between the first portion 411 and the two connecting portions 44, and gaps are formed between the two contact arms 45 and the first portion 411 as well as between the two contact arms 45 and the two connecting portions 44. A width of each contact arm 45 remains unchanged in an extending direction thereof, and the position limiting portions 422 are located right above the contact arms 45.

Figure 6:
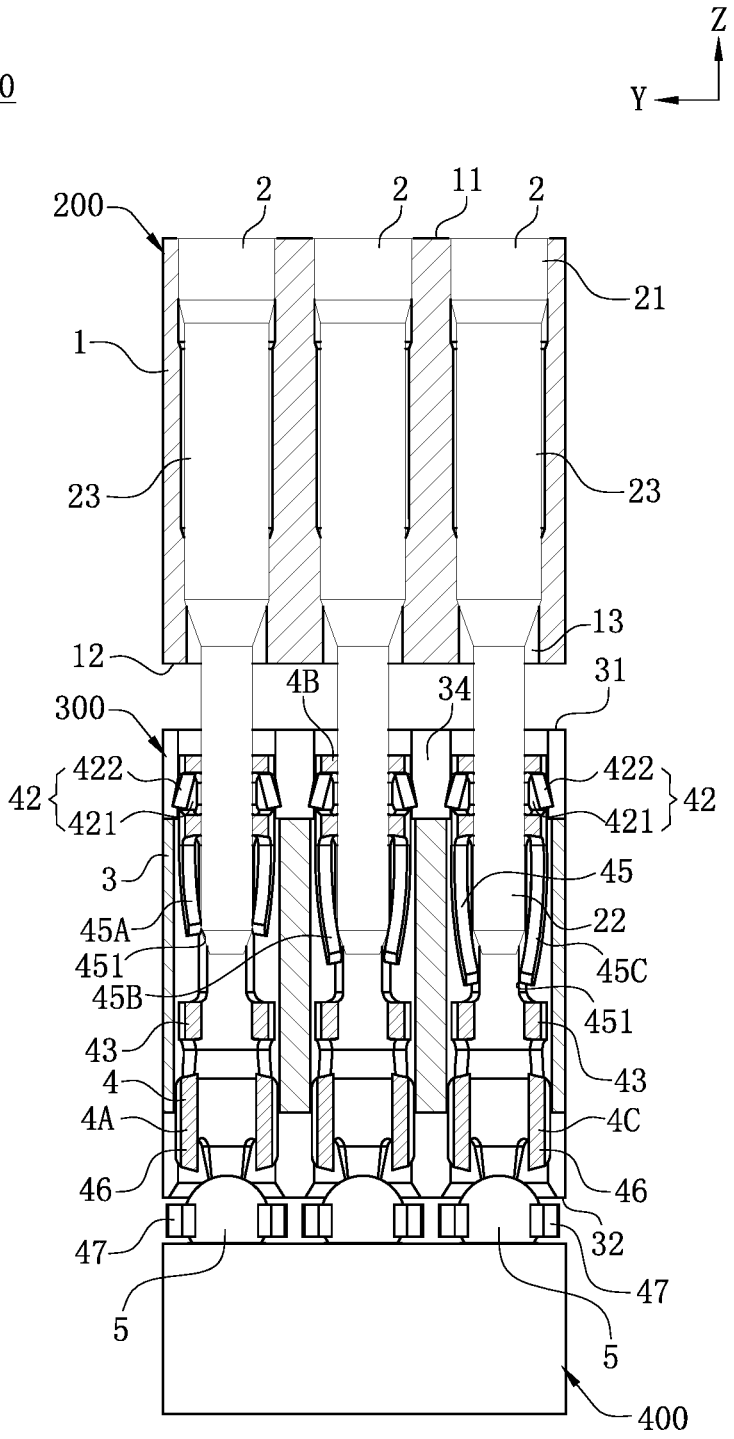
FIG. 6 is a schematic view of a second terminal and a corresponding pin in FIG. 5 when the second terminal and the pin corresponding are just inserted.

Referring to FIG. 5, FIG. 6 and FIG. 7, the two contact arms 45 of the same terminal 4 is located at a same height, and the two contact arms 45 of the different terminals 4 are located at different heights and configured for the pins 2 to insert downward therein successively. Upper ends of the two contact arms 45 of the different terminals 4 are located at a same height, and lower ends of the two contact arms 45 of the different terminals 4 are located at different heights. Structures of the different terminals 4 other than the two contact arms 45 are all identical, which simplifies the forming process of the different terminals 4. The insertion portion 22 is downward inserted between the two contact arms 45 and is clamped by the two contact arms 45, and an inner surface of a free end of each contact arm 45 forms an arc-shaped surface 451 to be in contact with an outer surface of the insertion portion 22.

Referring to FIG. 3, FIG. 5 and FIG. 8, each first terminal 4A has two first contact arms 45A opposite and close to each other. Each second terminal 4B has two second contact arms 45B opposite and close to each other. Each third terminal 4C has two third contact arms 45C opposite and close to each other. A downward extending length of each of the two first contact arms 45A is smaller than a downward extending length of the two second contact arms 45B, and the downward extending length of the two second contact arms 45B is smaller than a downward extending length of the two third contact arms 45C, such that the two second arms 45 of the different terminals 4 located at different heights.

Referring to FIG. 5, FIG. 6 and FIG. 7, when the pins 2 are downward inserted with the terminals 4 correspondingly, firstly, the two first contact arms 45A are inserted with the insertion portion 22 corresponding to the two first contact arms 45A, then the two second contact arms 45B are inserted with the insertion portion 22 corresponding to the two second contact arms 45B, and finally the two third contact arms 45C are inserted with the insertion portion 22 corresponding to the two third contact arms 45C, such that the first terminals 4A, the second terminals 4B and the third terminals 4C are inserted with the corresponding insertion portions 22 at different time, and a maximum insertion force of the pins 2 is reduced.

Referring to FIG. 3, FIG. 5 and FIG. 8, the two positioning portions 46 bend and extend forward from left and right sides of an upper end of the second portion 412. The two positioning portions 46 are hollow cylindrical shaped, and an aperture of each of the two positioning portions 46 is greater than the aperture of each of the two second extending portions 43, which ensures that a gap exists between the two second extending portions 43 and the accommodating hole 33 when the two positioning portions 46 and the accommodating hole 33 are positioned. A gap between front ends of the two positioning portions 46 is larger than the gap between the front ends of the two connecting portions 44, which ensures that there is a sufficient deformation space between the front ends of the two positioning portions 46. A width of each positioning portion 46 is gradually increased in an extending direction thereof, which increases the strength of the positioning portions 46, and an outer surface of each positioning portion 46 abuts an inner wall surface of the corresponding accommodating hole 33, which increases an interaction area between the positioning portions 46 and the corresponding accommodating hole 33, so as to position the terminal 4 in a horizontal direction.

Figure 10:
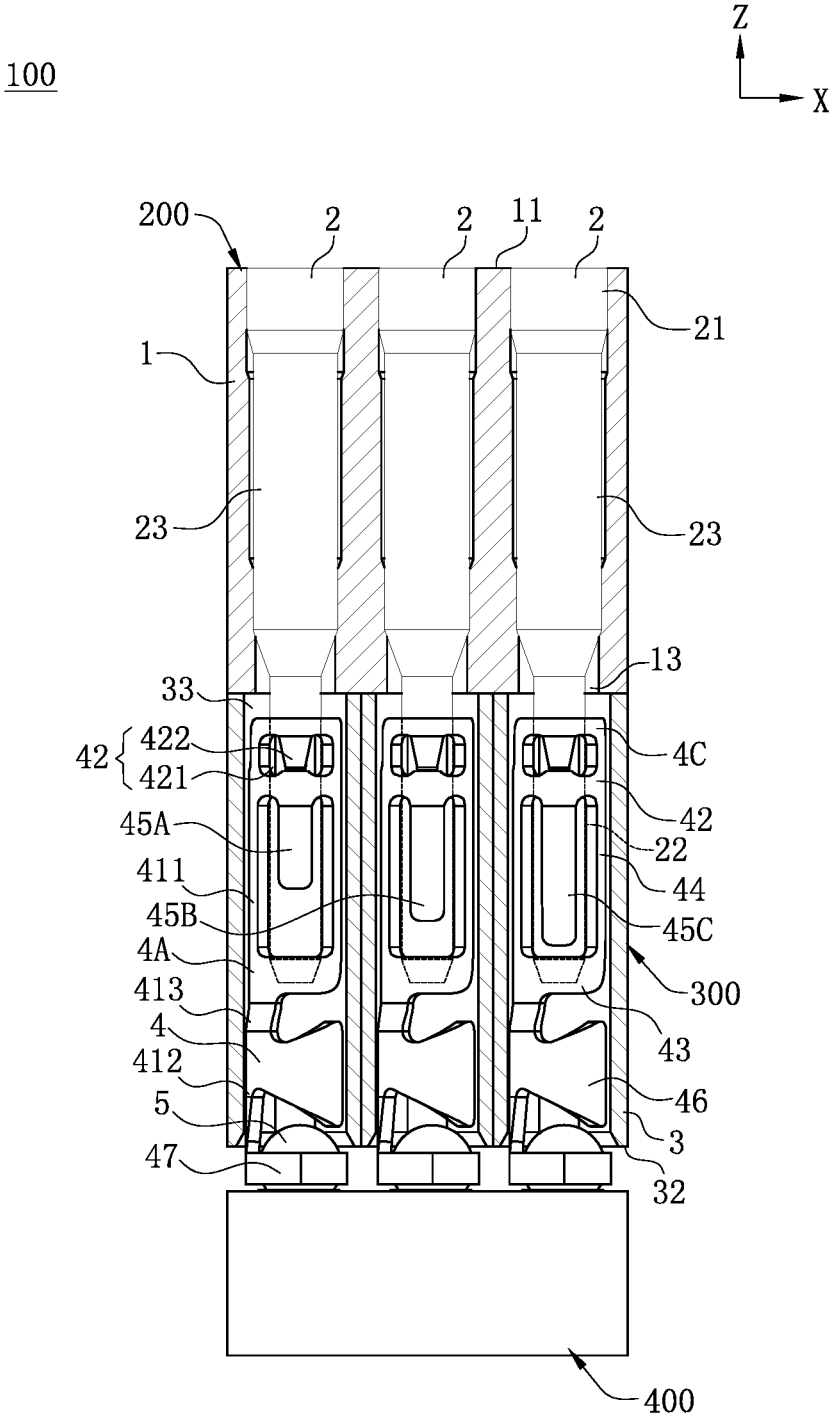
FIG. 10 is a schematic view of an electrical connector and a plug in FIG. 9 after insertion.

Referring to FIG. 7 and FIG. 10, when the pins 2 are downward inserted into a final position, a lower end of the insertion portion 22 is located above the positioning portions 46, which can avoid a lower end of each pin 2 from colliding with an upper end of each positioning portion 46 and consequently being damaged, thereby prolonging the service life of the electrical connector assembly 100.

Referring to FIG. 3, FIG. 5 and FIG. 8, the two clamping portions 47 bend and extend forward from left and right sides of a lower end of the second portion 412. The two clamping portions 47 are located below the lower surface 32 and used for clamping the solder 5, so as to solder the electrical connector 300 to the circuit board 400.

To sum up, the electrical connector and the electrical connector assembly according to certain embodiments of the present invention have the following beneficial effects:

(1) The upper ends of the terminals 4 are located at the same height, and the lower ends of the terminals 4 are located at the same height. When the electrical connector 300 is inserted with the plug 200, signal interference between the terminals 4 can be reduced, ensuring that transmission of a high-speed signal can be stably conducted between the electrical connector 300 and the plug 200, and the accommodating holes 33 correspondingly accommodating the terminals 4 may adopt an identical structure, thus facilitating forming of the body 3. Meanwhile, the two contact arms 45A of the first terminal 4 and the two contact arms 45B of the second terminal 4B are located at different heights and configured for the pins 2 to insert downward therein successively, reducing the maximum insertion force of the plug 200 inserted into the electrical connector 300, and prolonging service life of the electrical connector assembly 100.

(2) The structures of the first terminal 4 and the structures of the second terminal 4B other than the two contact arms 45 are all identical, which simplifies the forming process of the first terminal 4A and the second terminal 4B.

(3) The two connecting portions 44 of each terminal 4 abut each other, thereby allowing the two connecting portions 44 to be electrically conductive to each other, and further improving signal transmission capacity between the pins 2 and the terminals 4.

(4) The two first extending portions 42, the two second extending portions 43, the two positioning portions 46 and the two clamping portions 47 of each terminal 4 all bend and extend from the left and right sides of the base 41 toward the front side of the base 41, which reduces space occupied by each terminal 4 in the corresponding accommodating hole 33, such that the terminals 4 can be arranged more compactly.

(5) The notch 414 is downwards concavely provided on the upper end of the base 41, and there is the interval between the notch 414 and the through hole 421. Such arrangement of the notch 414 and the through hole 421 facilitates that the position limiting portions 422 deform inward, and the position limiting portions 422 move upward into the groove 34.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured for a plug having a plurality of pins to downward insert therein, the electrical connector comprising:

a body, provided with a plurality of accommodating holes running through an upper surface and a lower surface of the body; and a plurality of terminals, correspondingly accommodated in the accommodating holes, wherein upper ends of the terminals are located at a same height, lower ends of the terminals are located at a same height, each of the terminals has two contact arms opposite and close to each other, the terminals include a first terminal and a second terminal, and the two contact arms of the first terminal and the two contact arms of the second terminal are located at different heights and correspondingly configured for the pins to insert downward therein successively.

2. The electrical connector according to claim 1, wherein upper ends of the two contact arms of the first terminal and upper ends of the two contact arms of the second terminal are located at a same height, and lower ends of the two contact arms of the first terminal and lower ends of the two contact arms of the second terminal are located at different heights.

3. The electrical connector according to claim 1, wherein structures of the first terminal and the second terminal other than the two contact arms are all identical.

4. The electrical connector according to claim 1, wherein each of the terminals comprises a base, two first extending portions and two second extending portions respectively bending and extending from two opposite sides of the base, and two connecting portions respectively connecting the two first extending portions to the two second extending portions, the two contact arms are formed by respectively extending from the two first extending portions toward the two second extending portions, and extending lengths of the two contact arms of the first terminal and extending lengths of the two contact arms of the second terminal are different.

5. The electrical connector according to claim 4, wherein the first extending portions are located above the second extending portions, and in a vertical direction, a width of each of the first extending portions is greater than a width of each of the second extending portions.

6. The electrical connector according to claim 4, wherein a gap between the two second extending portions is gradually decreased along a direction toward the two first extending portions.

7. The electrical connector according to claim 4, wherein the two connecting portions abut each other.

8. The electrical connector according to claim 4, wherein each of the terminals further comprises two positioning portions bending and extending from the two opposite sides of the base, and two clamping portions bending and extending from the two opposite sides of the base, the two second extending portions are located between the two first extending portions and the two positioning portions, the two positioning portions are configured to position the terminal on the body, and the two clamping portions are located below the two positioning portions and configured to clamp a solder.

9. The electrical connector according to claim 8, wherein a gap between the two connecting portions is smaller than a gap between the two positioning portions.

10. The electrical connector according to claim 8, wherein the two first extending portions, the two second extending portions and the two positioning portions are all hollow cylindrical shaped, an aperture of each of the two first extending portions is equal to an aperture of each of the two second extending portions, and an aperture of each of the two positioning portions is greater than the aperture of each of the two second extending portions.

11. The electrical connector according to claim 8, wherein the two first extending portions, the two second extending portions, the two positioning portions and the two clamping portions all bend and extend respectively from a left side and a right side of the base toward a front side of the base.

12. The electrical connector according to claim 8, wherein a width of each of the positioning portions is gradually increased in an extending direction thereof, and the positioning portions outward abut a corresponding one of the accommodating holes so as to position the terminal in a horizontal direction.

13. The electrical connector according to claim 8, wherein when the pins are downwards inserted into a final position thereof, a lower end of each of the pins is located above a corresponding one of the positioning portions.

14. The electrical connector according to claim 1, wherein a groove is formed between two adjacent ones of the accommodating holes to communicate the two adjacent ones of the accommodating holes with each other, the groove is downward concavely provided on an upper surface of the body, each of the terminals is protrudingly provided with two position limiting portions opposite to each other, the two position limiting portions are located above the two contact arms, two adjacent position limiting portions of two adjacent terminals of the terminals are accommodated in a same groove, and a bottom surface of the groove is located below the position limiting portions to limit the terminals from moving downward.

15. The electrical connector according to claim 14, wherein each of the terminals has two through holes opposite to each other, the position limiting portions are formed by extending downward and outward from upper ends of the through holes correspondingly, and intervals exist between each of the position limiting portions and two opposite side edges of a corresponding one of the through holes.

16. The electrical connector according to claim 15, wherein each of the terminals has a notch formed by being downward concavely provided on an upper end of the terminal, and intervals exist between the notch and the through holes.

17. An electrical connector assembly, comprising:

a plug, comprising a base seat and a plurality of pins fixed to the base seat; and an electrical connector, mated with the plug, the electrical connector comprising:

a body, provided with a plurality of accommodating holes penetrating vertically; and a plurality of terminals, correspondingly accommodated in the accommodating holes, wherein upper ends of the terminals are located at a same height, lower ends of the terminals are located at a same height, each of the terminals has two contact arms opposite and close to each other, the terminals include a first terminal and a second terminal, and the two contact arms of the first terminal and the two contact arms of the second terminal are located at different heights and correspondingly configured for the pins to insert downward therein successively.

18. The electrical connector assembly according to claim 17, wherein each of the pins has a head portion, an insertion portion and a middle portion connecting the head portion to the insertion portion, a diameter of the head portion, a diameter of the insertion portion and a diameter of the middle portion are different, the insertion portion extends downward to pass beyond a bottom surface of the base seat and is downward inserted and in contact with the two contact arms, and the middle portion and the base seat are in stationary fit.

19. The electrical connector assembly according to claim 18, wherein the diameter of the head portion is greater than the diameter of the middle portion, and the diameter of the middle portion is greater than the diameter of the insertion portion.

20. The electrical connector assembly according to claim 17, wherein the pins are correspondingly riveted and fixed to the based seat downward from top thereof, and upper ends of the pins are located at a same height and are flush with a top surface of the base seat.

* * * * *